United States Patent [19]

Pitschi

[11] Patent Number: 4,763,090

[45] Date of Patent: Aug. 9, 1988

[54] COAXIAL-LINE SECTION

[75] Inventor: Franz-Xaver Pitschi, Rottach-Egern, Fed. Rep. of Germany

[73] Assignee: Spinner GmbH, Elektrotechnische Fabrik, Munich, Fed. Rep. of Germany

[21] Appl. No.: 135,344

[22] Filed: Dec. 21, 1987

[30] Foreign Application Priority Data

Dec. 23, 1986 [DE] Fed. Rep. of Germany ..... 3644279

[51] Int. Cl.[4] ..... H01P 3/06; H01R 11/01

[52] U.S. Cl. ..... 333/260; 174/13; 174/21 C; 439/33

[58] Field of Search ..... 174/13, 21 C, 21 CA, 174/86, 88 C, 99 E; 333/260, 245; 439/33, 578; 285/187, 224; 403/28, 29, 30

[56] References Cited

U.S. PATENT DOCUMENTS 3,432,779 3/1969 Sewell ..... 333/260

4,390,218 6/1983 Kruger ..... 439/33

*Primary Examiner*—Laramie E. Askin

*Attorney, Agent, or Firm*—Henry M. Feiereisen

[57] ABSTRACT

A coaxial-line section includes an outer conductor and an inner conductor tube centered coaxially inside the outer conductor and contacted by couplings which are supported by insulators or beads. The couplings are provided at their facing ends with a ring of laminated springs which allow the thermal expansion of the inner conductor tube. Extending inside along the inner conductor tube are two preferably bar-shaped displacement compensating elements. The axial inner end of each displacement compensating element is firmly anchored to the inner conductor tube while its axial outer free end defines with the end faces of the respective coupling a stop face.

12 Claims, 2 Drawing Sheets

COAXIAL-LINE SECTION

BACKGROUND OF THE INVENTION

The present invention relates to a coaxial-line section.

A coaxial-line section of the concerned type includes an outer conductor provided with a connecting flange at each end thereof and surrounding an insulator or bead for centering an inner conductor coupling. Each end of the coupling is provided with a supporting ring which is surrounded by a ring of compound springs for contacting an inner conductor and allowing a thermal expansion of the latter.

When transmitting very high RF-powers through coaxial lines consisting of such sections, the coaxial line is considerably heated up whereby the excess temperature of the inner conductor is substantially higher than that of the outer conductor. For example, at a power of 15 MW and an ambient temperature of 40° C., the temperature of an inner conductor of copper may rise to 250° C. or more while the temperature of an outer conductor of aluminum may rise to 110° C. and more, thereby causing considerable thermal expansions. Since the expansion of the inner conductor exceeds the thermal expansion of the outer conductor, the laminated spring rings contacting the inner conductor are dimensioned with sufficient length for compensating the greater expansion of the inner conductor tube without encountering constraining forces even when considering manufacturing tolerances and dimensional tolerances. Taking into account these considerations, a section with a mean length of for example 5 m results in a length for the laminated springs of up to several centimeters. Even when assuming a horizontal laying of the coaxial-line section, the expansion of the inner conductor tube will not be uniform at both its ends so that the cross sectional center plane of the inner conductor tube which defines the center of gravity does not remain stationary. This is even more true upon slanting or vertical laying of the coaxial-line sections.

Consequently, upon laying of the coaxial-line section or during the course of several switching cycles, one end of the inner conductor tube will completely cover the laminated spring while the other laminated spring ring has to compensate all assembling tolerances and the entire thermal expansion. Taking into account that this respective end of the inner conductor tube should not be out of contact from the laminated spring ring even at lowest ambient temperatures, it is evident that these conditions will not guarantee a secure contacting between the inner conductor tube and the respective inner conductor couplings because the available spring deflection in the direction toward the root of the laminated springs decreases while the spring force increases in the direction toward the exposed and the supporting ring facing end of the laminated springs. Especially when transmitting very high RF-powers, an absolute secure contacting is mandatory. However, such known coaxial-line section satisfies this requirement for the above-stated reasons only in the central area of the laminated springs.

SUMMARY OF THE INVENTION

It is thus an object of the present invention to provide an improved coaxial-line obviating the afore-stated drawbacks.

This object and others which will become apparent hereinafter are attained in accordance with the present invention by arranging inside the inner conductor tube two displacement compensating elements with their axial inner ends connected to the inner conductor and their axial outer free ends cooperating with the end faces of the supporting rings to define respective stop faces. The required length of the displacement compensating elements can be calculated according to the following equations:

$$2\cdot\alpha_V\cdot\Delta t_{I/U}\cdot l_V+\alpha_I\cdot\Delta t_{I/U}\cdot d_I\leqq\alpha_A\cdot\Delta t_{A/U}\cdot l_A; \quad (1)$$

$$2\cdot l_V+d_I\approx l_I; \quad (2)$$

wherein $l_A$ is the length of the outer conductor, $l_I$ is the length of the inner conductor tube, $l_V$ is the length of a displacement compensating element, $d_I$ is the distance between the fixed connections of the inner ends of the compensating elements to the inner conductor tube, $\alpha_A$ is the thermal expansion coefficient of the outer conductor, tube, $\alpha_I$ is the thermal expansion coefficient of the inner conductor tube, $\alpha_V$ is the thermal expansion coefficient of the displacement compensating elements, $\Delta t_{A/U}$ is the maximum temperature drop between the outer conductor and the surroundings, and $\Delta t_{I/U}$ is the maximum temperature drop between the inner conductor and the surroundings.

Through the provision of such a coaxial-line section, the inner conductor tube thermally expands uniformly at its ends independent of its fitting position so that the cross sectional center plane or the center of gravity of the inner conductor tube remains essentially constant at each working state.

The sum of the thermal expansions of the displacement compensating elements, on the one hand, and of the inner conductor section extending between the fixed connections of the displacement compensating elements to the inner conductor tube, on the other hand, corresponds at the most to the thermal expansion of the outer conductor. If desired, this sum of thermal expansions may be dimensioned also slightly smaller than the thermal expansion of the outer conductor so as to consider for example also the—in absolute terms—small thermal expansion of the inner conductor couplings.

Thus, a predetermined tolerance gap between the free end of one displacement compensating element and the opposing end face of the respective supporting ring remains essentially constant at each temperature of the coaxial-line section when assuming the most unfavorable case in which the other displacement compensating element abuts with its free end the end face of the other supporting ring. Consequently, the inner conductor tube is able to move to one or the other direction from its geometric central position between both couplings at the most by half the tolerance gap. The laminated spring ring can thus be designed with shorter dimensions and yet continuously provides an optimal contacting. Both ends of the inner conductor tube shift uniformly relative to the respective laminated spring ring thereby allowing a same self-cleaning of the contacting areas at both ends of the inner conductor tube.

Preferably, the two displacement compensating elements are integrated into a continuous one-piece unit and are made of a material with a thermal expansion coefficient satisfying the following equation:

$$\alpha_V \approx \frac{\Delta t_{A/U}}{\Delta t_{I/U}} \cdot \alpha_A; \quad (3)$$

The use of a material for the displacement compensating elements with a thermal expansion coefficient as in equation (3) is however rather expensive so that in accordance with another feature of the present invention, it is proposed to use a material with a next higher thermal expansion coefficient and to provide a sufficient base gap between the axial outer ends of the displacement compensating elements and the opposing end face of the couplings to receive the slightly larger thermal expansion of the compensating elements.

It may, however, also be advisable to further slightly increase the base gap in order to take into account the faster temperature rise and slower temperature drop of the inner conductor tube in comparison to the outer conductor.

Suitably, each displacement compensating element are supported along its major portion by respective brackets which allow an axial displacement of the compensating elements relative to the inner conductor tube. Preferably, the brackets provide a contact between the compensating elements and the inner conductor tube to prevent resonance in the interior space of the inner conductor tube.

According to a further feature of the present invention, sectional bars are preferably used as displacement compensating elements because they are easy to manufacture and all of reduced weight. Their small weight is especially relevant in horizontal or almost horizontal laying of coaxial-line of considerable length because a sagging of the inner conductor tube is kept within acceptable limits.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
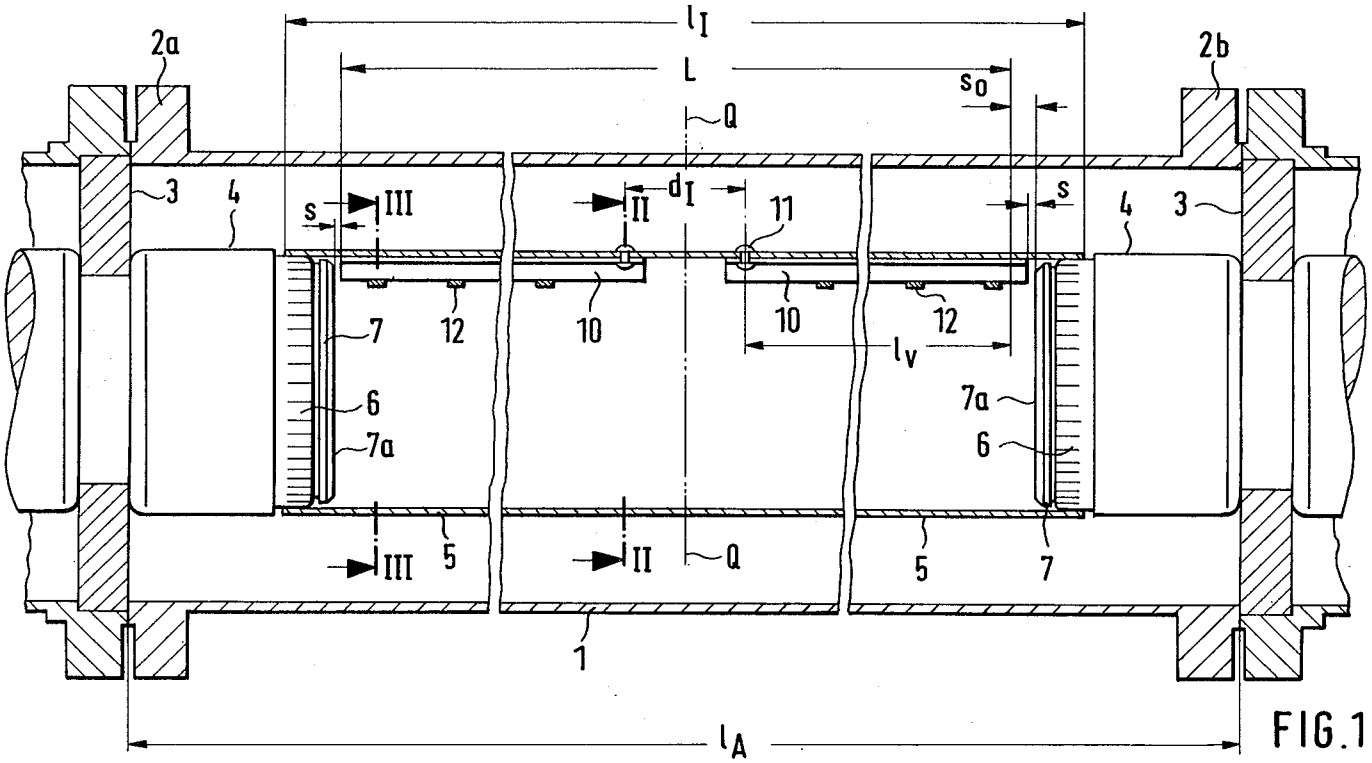
FIG. 1 is a schematically simplified longitudinal section in shortened illustration of one embodiment of a coaxial-line section with the left hand side showing the latter at working temperature and and the right hand side in a cold state.
Figure 2:
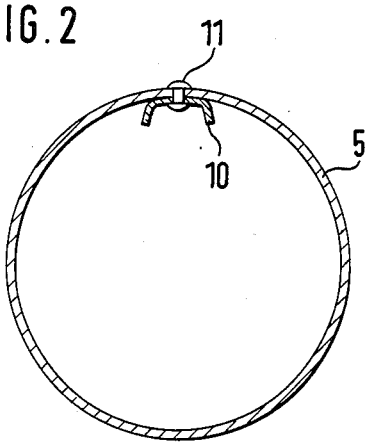
FIG. 2 is a cross sectional view of the coaxial-line section taken along the line 2—2 in FIG. 1.

In the drawing, one embodiment of a coaxial-line section is illustrated which includes an outer conductor 1 of a length $l_A$ and provided with a connecting flange *2a, 2b* at each axial end thereof. The flanges *2a, 2b* which are adapted for connection with respective flanges of further coaxial-line sections to be connected at each side, support respective insulators or beads 3 which have a central bore for supporting inner conductor couplings 4 in a position coaxial with the outer conductor 1. At their free end remote to the beads 3, the couplings 4 are provided at both free ends (only one end is shown in FIG. 1) with a ring of compound springs in the form of leaf or laminated springs 6 which are prestressed radially outwardly. Extending between the facing laminated spring rings 6 for contacting the couplings 4 is an inner conductor tube 5 which is shown in FIG. 1 in shortened illustration and has a length $l_I$. Each laminated spring ring 6 surrounds a supporting ring 7 which receives the load of the inner conductor tube 5 and transmits it to the coupling 4. Although not shown in detail, each supporting ring 7 further limits the spring deflection of the laminated springs 6 when the inner conductor tube 5 is not yet pushed over the spring ring 6.

Figure 3:
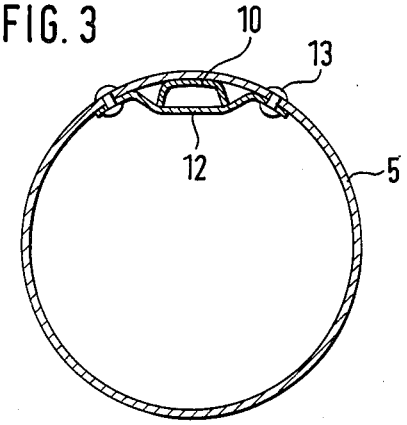
FIG. 3 is a cross sectional view of the coaxial-line section taken along the line 3—3 in FIG. 1.

As shown in the nonlimiting example of FIG. 1, the inner conductor tube 5 is provided at its inner wall surface with displacement compensating elements in the form of two sectional bars 10 of inverted U-shape. Each sectional bar 10 is firmly anchored at its inner end to the inner conductor tube 5 by means of a rivet 11. Certainly any other suitable fixed connection for attaching the inner facing ends of the sectional bars 10 other than rivets 11 may be employed. The remaining portion of each sectional bar 10 is guided for longitudinal displacement relative to the inner conductor tube 5 by a plurality of spaced metallic supports or brackets 12. Each bracket 12 is suitably connected at its respective ends to the inner conductor tube 5 e.g. by rivets 13 (see FIG. 3) and has a central horizontal portion which supports the sectional bar 10.

The outer free axial end of each sectional bar 10 cooperates with the respective end face *7a* of the supporting ring 7 to define a stop face and is spaced from the end face *7a* of the supporting ring 7 by a tolerance gap s during operation at increased temperature as indicated in the left hand side of FIG. 1 and indicated by broken lines in the right hand side of FIG. 1 or when being in a cold state by a basic gap $s_o$ as indicated in the right hand side in FIG. 1.

In the nonlimiting example of FIG. 1, the sectional bars 10 are of the same length, with the rivets 11 spaced from each other by a distance $d_I$ symmetrical to the cross sectional center plane Q. It will be appreciated, however, that both these structural features are made by way of example and may be modified as will be described further below. It should be further noted that the cross section and fitting position of the sectional bars 10 is arbitrary and may thus differ from the example as shown in the drawing.

The metallic brackets 12 electrically contact the sectional bars 10 with the inner conductor tube 5 and are sufficiently spaced from each other in order to prevent the occurrence of standing waves which otherwise might be excited by those parts of the electric field penetrating into the inner conductor tube 5 via gaps, especially via the slots between the laminated springs 6. When transmitting very high RF-powers through this coaxial-line section, the unavoidable losses lead to a substantial heating, with the temperature rise of the inner conductor tube 5 considerably exceeding the temperature of the outer conductor 1. Consequently, the inner conductor tube 5 is subjected to an increased thermal expansion in comparison to the outer conductor 1 and based on the assumption that the coaxial-line section in FIG. 1 is shown in a cold state is moved further over the laminated spring rings 6.

The overall displacement can be calculated in known manner based on the heat expansion coefficient of the outer conductor material and the inner conductor material, the respective excess temperatures and the respective lengths. The thermal expansion of the inner conductor couplings 4 is negligible as their axial length are small in comparison to the overall length of the coaxial-line section.

The sectional bars 10 are provided as displacement compensating elements which ensure that the inner conductor tube 5 expands almost uniformly with its both ends over both laminated spring rings 6 during heating and, after recooling, returns to the illustrated position or to a position which differs from the previous at most by the base gap $s_o$ so that the cross sectional center plane Q remains basically stationary at all working temperatures except for the distance in accordance with the base gap $s_o$. This is accomplished when the length L between the free ends of the sectional bars 10 has a thermal linear expansion which approximately corresponds to the thermal expansion of the outer conductor 1 with the length $l_A$. Inasmuch as this relationship is not met, in one case the gap $s_o$ is reduced with increasing heating toward zero, or even axial constraining forces may occur, while in the other case the gap $s_o$ increases with increasing heating. The thermal expansion of the inner conductor couplings 4 can again be neglected.

When disregarding the gap $s_o$ or s, then the sum of the thermal expansions of the sectional bars 10 and of the inner conductor section $d_I$ should not exceed and not essentially be smaller than the thermal expansion of the outer conductor. Thus the following equations apply:

$$2\cdot\alpha_V\cdot\Delta t_{I/U}\cdot l_V+\alpha_I\cdot\Delta t_{I/U}\cdot d_I\leqq\alpha_A\cdot\Delta t_{A/U}\cdot l_A; \quad (1)$$

$$2\cdot l_V+d_I\approx l_I; \quad (2)$$

wherein $l_A$ is the length of the outer conductor 1, $l_I$ is the length of the inner conductor tube 5, $l_V$ is the length of a displacement compensating element 10, $d_I$ is the distance between the rivets 11, $\alpha_A$ is the thermal expansion coefficient of the outer conductor 1, $\alpha_I$ is the thermal expansion coefficient of the inner conductor 5, $\alpha_V$ is the thermal expansion coefficient of the displacement compensating elements 10, $\Delta t_{A/U}$ is the maximum temperature drop between the outer conductor and the surroundings, and $\Delta t_{I/U}$ is the maximum temperature drop between the inner conductor and the surroundings.

By selecting for the sectional bars 10 a material with an expansion coefficient which is small in comparison to expansion coefficients of standard materials for outer and inner conductors (like e.g. aluminum and copper), the length of the sectional bars 10 and the distance $d_I$ of the rivets 11 can be calculated in accordance with the above equations. Consequently, it follows also that the sectional bars 10 do not have to be of a same length and the fixed connections 11 do not have to be arranged symmetric to the cross sectional center plane Q. The lengths of the sectional bars 10 as determined in accordance with the equations (1) and (2) are then reduced by the magnitude of the tolerance gap s as defined through empirical values.

In order for the sectional bars 10 to meet the equations (1) and (2) it can easily be determined that for frequently used materials like aluminum for the outer conductor 1 and copper for the inner conductor 5, only expensive special alloys have a sufficiently small thermal expansion coefficient, even when using instead of two sectional bars 10 as illustrated in FIG. 1 only one continuous bar which is firmly anchored to the inner conductor tube 5 in the cross sectional plane Q of the latter. In this case, $d_I=0$ and $l_I\approx l_A$ so that in accordance with equations (1) and (2) the material for the single bar has a thermal expansion coefficient $\alpha_V$ of:

$$\alpha_V\approx\frac{\Delta t_{A/U}}{\Delta t_{I/U}}\cdot\alpha_A; \quad (3)$$

Considering that the thermal expansion coefficient for aluminum is $\alpha_A=24\cdot10^{-6}$ K.$^{-1}$ and $\Delta t_{A/U}=20$ K. and $\Delta t_{I/U}=60$ K., then this material should have a thermal expansion coefficient of $$\alpha_V=\tfrac{1}{3}\alpha_A=8\cdot10^{-6}\ \text{K.}^{-1}.$$

Since for economical reasons the use of a special alloy with such a thermal expansion coefficient is not suitable, a material is selected instead which has a next higher thermal expansion coefficient e.g. unalloyed steel with $\alpha_{V\,ist}=12\cdot10^{-6}$ K.$^{-1}$. The excessive thermal expansion of a continuous bar of unalloyed steel in comparison to the calculated value can be compensated at both sides by a small base gap $s_o$ which can be determined without consideration of the tolerance gap s as follows:

$$s_o\geqq(\alpha_{V\,ist}-\alpha_V)\cdot l_V\cdot\Delta t_{I/U}; \quad (3a)$$

For the stated values and for an assumed length of the coaxial-line section of about 5 m, i.e. with $l_V\approx2500$ mm, in accordance with the equation (3a) the base gap $s_o\geqq0.6$ mm.

While the invention has been illustrated and described as embodied in a Coaxial-Line Section, it is not intended to be limited to the details shown since various modifications and structural changes may be made without departing in any way from the spirit of the present invention.

What is claimed as new and desired to be protected by Letters Patent is set forth in the appended claims:

1. A coaxial-line section; comprising:

an outer conductor provided with a connecting flange at each end thereof;

an inner conductor;

supporting means for supporting said inner conductor in a position coaxial with said outer conductor;

displacement compensating means including two displacement compensating elements each being arranged in said inner conductor and having an axial inner end and an axial outer free end, said supporting means having an end face defining a stop face with said outer free end of said displacement compensating elements; and anchoring means for firmly connecting said inner ends of said displacement compensating elements to said inner conductor, said displacement compensating elements fulfilling the following equations:

$$2\cdot\alpha_V\cdot\Delta t_{I/U}\cdot l_V+\alpha_I\cdot\Delta t_{I/U}\cdot d_I\leqq\alpha_A\cdot\Delta t_{A/U}\cdot l_A; \quad (1)$$

$$2\cdot l_V+d_I\approx l_I; \quad (2)$$

wherein $l_A$ is the length of said outer conductor, $l_I$ is the length of said inner conductor, $l_V$ is the length of one displacement compensating element, $d_I$ is the distance between said anchoring means, $\alpha_A$ is the thermal expansion coefficient of said outer conductor, $\alpha_I$ is the thermal expansion coefficient of said inner conductor, $\alpha_V$ is the thermal expansion coefficient of said displacement compensating elements, $\Delta t_{A/U}$ is the maximum temperature drop between said outer conductor and the surroundings, and $\Delta t_{I/U}$ is the maximum temperature drop between said inner conductor and the surroundings.

2. A coaxial-line section as defined in claim 1 wherein said supporting means includes an insulator surrounded by said outer conductor at least in the area of its ends, an inner conductor coupling supported in a central bore of said insulator and having a supporting ring and a ring of laminated springs surrounding said supporting ring and contacting said inner conductor.

3. A coaxial-line section as defined in claim 1 wherein said inner conductor defines a cross sectional center plane, said displacement compensating elements being connected to each other to define a one-piece unit, said anchoring means connecting said one-piece displacement compensating element with said inner conductor in the cross sectional center plane, said one-piece displacement compensating element being made of a material fulfilling the following equation:

$$\alpha_V \approx \frac{\Delta t_{A/U}}{\Delta t_{I/U}} \cdot \alpha_A; \tag{3}$$

4. A coaxial-line section as defined in claim 3 wherein said one-piece displacement compensating element is made of a material with a thermal expansion coefficient greater than the thermal expansion coefficient of said displacement compensating element according to equation (3) and with a length which is dimensioned in such a manner that in the cold state between said respective free end of said one-piece displacement compensating element and said facing end face of said supporting means a base gap is maintained in accordance with the following equation:

$$s_o \geqq (\alpha_{V\,ist} - \alpha_V) \cdot l_V \Delta t_{I/U}; \tag{3a}$$

wherein $s_o$ is the base gap; and $\alpha_{V\,ist}$ is the thermal expansion coefficient of said one-piece displacement compensating element.

5. A coaxial-line section as defined in claim 1, and further comprising bearing means for additionally connecting said displacement compensating means to said inner conductor and allowing an axial displacement of said inner conductor relative to said displacement compensating means.

6. A coaxial-line section as defined in claim 5 wherein said bearing means contacts said displacement compensating means with said inner conductor.

7. A coaxial-line section as defined in claim 5 wherein said bearing means includes a bracket the ends of which being fastened to said inner conductor and having a central horizontal portion supporting said displacement means.

8. A coaxial-line section as defined in claim 7 wherein said bracket is of metal.

9. A coaxial-line section as defined in claim 1 wherein said displacement compensating elements are sectional bars.

10. A coaxial-line section as defined in claim 9 wherein said sectional bars are of inverted U-shape.

11. A coaxial-line section as defined in claim 1 wherein said anchoring means includes a rivet.

12. A coaxial-line section; comprising:

an outer conductor;

an inner conductor;

supporting means for supporting said inner conductor in a position coaxial with said outer conductor;

displacement compensating means for providing a uniform dimensional change of said inner conductor relative to its cross sectional center plane during the heating phase and cooling phase, said displacement compensating means being arranged in said inner conductor and having an axial inner end and an axial outer free end, said supporting means having an end face defining a stop face with said outer free end of said displacement compensating elements; and anchoring means for firmly connecting said inner ends of said displacement compensating elements to said inner conductor.

* * * * *